US010485352B2

(12) United States Patent
Choi

(10) Patent No.: US 10,485,352 B2
(45) Date of Patent: Nov. 26, 2019

(54) SUPPORTING LEG ASSEMBLY OF FOLDABLE BED FRAME AND FOLDABLE BED FRAME HAVING SAME

(71) Applicant: Inno-Sports Co., Ltd., Xiamen (CN)

(72) Inventor: Kwan Jun Choi, Xiamen (CN)

(73) Assignee: Inno-Sports Co., LTD., Xiamen (CN)

( * ) Notice: Subject to any disclaimer, the term of this patent is extended or adjusted under 35 U.S.C. 154(b) by 284 days.

(21) Appl. No.: 15/389,298

(22) Filed: Dec. 22, 2016

(65) Prior Publication Data

US 2017/0172307 A1 Jun. 22, 2017

(30) Foreign Application Priority Data

Dec. 22, 2015 (CN) ..... 2015 2 1077298 U

(51) Int. Cl.

| | |
|---|---|
| ***A47C 19/02*** | (2006.01) |
| ***A47C 19/12*** | (2006.01) |
| *A61G 1/013* | (2006.01) |
| *A47C 17/70* | (2006.01) |

(52) U.S. Cl.

CPC ..... *A47C 19/024* (2013.01); *A47C 19/025* (2013.01); *A47C 19/122* (2013.01)

(58) Field of Classification Search

CPC ... A47C 19/024; A47C 19/025; A47C 19/122; A47C 17/70; A61G 1/013

See application file for complete search history.

(56) References Cited

U.S. PATENT DOCUMENTS

| | | | |
|---|---|---|---|
| 202,685 | A | 4/1878 | White |
| 324,843 | A | 8/1885 | Horton |
| 337,415 | A | 3/1886 | McKeough |
| 893,364 | A | 7/1908 | Piaser |
| 1,196,253 | A | 8/1916 | Lovvy |
| 6,062,589 | A | 5/2000 | Cheng |
| 6,223,628 | B1 | 5/2001 | Barron |
| 6,575,656 | B2 | 6/2003 | Suh |
| 6,938,927 | B1 | 9/2005 | Martin |
| 7,066,676 | B2 | 6/2006 | Tsai |
| 7,144,078 | B2 | 12/2006 | Hsieh |
| 7,849,867 | B2 | 12/2010 | Takayama |
| 7,874,303 | B2 | 1/2011 | Xie |

(Continued)

FOREIGN PATENT DOCUMENTS

| | | |
|---|---|---|
| CN | 204336376 U | 5/2015 |
| CN | 204336377 U | 5/2015 |
| GB | 810195 A | 3/1959 |

*Primary Examiner* — Nicholas F Polito

*Assistant Examiner* — Alexis Felix Lopez

(74) *Attorney, Agent, or Firm* — Morgan, Lewis & Bockius LLP

(57) ABSTRACT

Disclosed are supporting leg assemblies and foldable bed frames. A supporting leg assembly includes a lateral bar, left and right legs, and left and right supporting pieces. The left and right legs are disposed under the left and right ends of the lateral bar, respectively. The left supporting piece is in contact with left sides of the left end of the lateral bar and the upper end of the left leg, and is fixedly coupled to the lateral bar and the left leg. The right supporting piece is in contact with right sides of the right end of the lateral bar and the upper end of the right leg, and is fixedly coupled to the first lateral bar and the right leg. The left and right supporting pieces are configured to connect and support sub-frames of a fold bed frame.

15 Claims, 5 Drawing Sheets

(56) References Cited

U.S. PATENT DOCUMENTS

| | | | | |
|---|---|---|---|---|
| 8,806,677 | B1 | 8/2014 | Bartelsmeyer | |
| 8,888,123 | B1 | 11/2014 | Cheng | |
| 9,027,952 | B2 | 5/2015 | Zhu | |
| 9,248,072 | B2 | 2/2016 | Wu | |
| 9,456,698 | B2 | 10/2016 | Oh | |
| 9,895,003 | B2 | 2/2018 | Choi | |
| 10,123,629 | B2 | 11/2018 | Choi | |
| 10,125,801 | B2 | 11/2018 | Wilson | |
| 10,285,506 | B2 | 5/2019 | Choi | |
| 2006/0062632 | A1 | 3/2006 | Jang | |
| 2007/0012346 | A1 | 1/2007 | Choi | |
| 2011/0099712 | A1 | 5/2011 | Jin | |
| 2012/0222216 | A1* | 9/2012 | Jin | A47C 19/028 5/400 |
| 2013/0276228 | A1* | 10/2013 | Hsieh | A47C 17/162 5/400 |
| 2015/0320225 | A1 | 11/2015 | Boyd | |
| 2015/0327684 | A1 | 11/2015 | Lee | |
| 2016/0157620 | A1 | 6/2016 | Oh | |
| 2018/0110339 | A1 | 4/2018 | Moon | |
| 2018/0192778 | A1 | 7/2018 | Choi | |
| 2018/0271296 | A1 | 9/2018 | Harrow | |
| 2018/0332973 | A1 | 11/2018 | Choi | |
| 2019/0029435 | A1 | 1/2019 | Choi | |
| 2019/0045938 | A1 | 2/2019 | Skaggs | |

* cited by examiner

1

SUPPORTING LEG ASSEMBLY OF FOLDABLE BED FRAME AND FOLDABLE BED FRAME HAVING SAME

CROSS-REFERENCE TO RELATED APPLICATIONS

The present application claims priority to Chinese Utility Model Application CN 201521077298.2 filed Dec. 22, 2015. The disclosure of the application is incorporated herein for all purposes by reference.

FIELD OF THE INVENTION

The present invention generally relates to leg assemblies and foldable bed frames. More particularly, the present invention relates to leg assemblies for connecting and supporting sub-frames of the foldable bed frames and the foldable bed frames having the supporting leg assemblies.

BACKGROUND

Nowadays, foldable beds have become increasingly popular. A foldable bed generally includes a foldable bed frame having sub-frames and support legs, and a mattress placed on the foldable bed frame. Of many current foldable bed frames such as the one illustrated in FIG. 1, legs 102 are usually placed below lateral bar 104. Pieces 106 for supporting sub-frames are disposed on both sides of the lateral bar. Pieces 106 do not form any contact with the legs, and are suspended with the lower portion hanging free. As a result, during the course of use, pieces 106 tend to bend, making the bed frame unstable and unsafe to use and reducing the lifetime of the bed frame.

Given the current state of the art, there remains a need for supporting leg assemblies, and foldable bed frames that address the abovementioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present invention provides supporting leg assemblies and foldable bed frames that are stable and safe to use.

In various embodiments, the present invention provides a supporting leg assembly including a first lateral bar, a left leg, a right leg, a left supporting piece, and a right supporting piece. The first lateral bar has a left end and a right end. The left leg is disposed under the left end of the first lateral bar and has an upper end fixedly coupled to the left end of the first lateral bar. The right leg is disposed under the right end of the first lateral bar and has an upper end fixedly coupled to the right end of the first lateral bar. The left supporting piece is in contact with a left side of the left end of the first lateral bar and a left side of the upper end of the left leg, and fixedly coupled to the left end of the first lateral bar and the upper end of the left leg. The right supporting piece is in contact with a right side of the right end of the first lateral bar and a right side of the upper end of the right leg, and fixedly coupled to the right end of the first lateral bar and the upper end of the right leg. The left and right supporting pieces are configured to connect and support sub-frames of a folding bed frame.

In some embodiments, the supporting leg assembly further includes a second lateral bar disposed between the left leg and the right leg, and having a left end fixedly coupled to the left leg and a right end fixedly coupled to the right leg.

In an exemplary embodiment, the left supporting piece is fixedly coupled to the left end of the first lateral bar and the upper end of the left leg by welding, and the right supporting piece is fixedly coupled to the right end of the first lateral bar and the upper end of the right leg by welding.

In some embodiments, each of the left and right supporting pieces is of an L-shape, including a first segment and a second segment substantially perpendicular to each other. The first segment of the left supporting piece is fixedly coupled to the left end of the first lateral bar and the upper end of the left leg, with an upper portion thereof abutting the left side of the left end of the first lateral bar and a lower portion thereof abutting the left side of the upper end of the left leg. The second segment of the left supporting piece is coupled to, or integrally formed at, the lower portion of the first segment of the left supporting piece, and extends leftward. The first segment of the right supporting piece is fixedly coupled to the right end of the first lateral bar and the upper end of the right leg, with an upper portion thereof abutting the right side of the right end of the first lateral bar and a lower portion thereof abutting the right side of the upper end of the right leg. The second segment of the right supporting piece is coupled to, or integrally formed at, the lower portion of the first segment of the right supporting piece, and extends rightward. In an embodiment, the first segment of each of the left and right supporting pieces includes a plurality of through-holes.

In various embodiments, the present invention provides a foldable bed frame including a first sub-frame, a second sub-frame, and a supporting leg assembly of the present invention to connect the first and second sub-frames. Each of the first and second sub-frames includes a left longitudinal bar and a right longitudinal bar. Proximal ends of the left longitudinal bars of the first and second sub-frames are pivotally connected to the left supporting piece of the supporting leg assembly, and proximal ends of the right longitudinal bars of the first and second sub-frames are pivotally connected to the right supporting piece of the supporting leg assembly.

In some embodiments, the proximal ends of the left longitudinal bars of the first and second sub-frames are pivotally connected to the first segment of the left supporting piece of the supporting leg assembly, and the proximal ends of the right longitudinal bars of the first and second sub-frames are pivotally connected to the first segment of the right supporting piece of the supporting leg assembly.

In an exemplary embodiment, the first segment of each of the left and right supporting pieces includes a first through-hole for pivotally connecting with the proximal end of the left or right longitudinal bar of the first sub-frame and a second through-hole for pivotally connecting with the proximal end of the left or right longitudinal bar of the second sub-frame.

In some embodiments, when the foldable bed frame is in an unfolded state, the proximal ends of the left longitudinal bars of the first and second sub-frames are located above and abut the second segment of the left supporting piece, thereby being at least partially supported by the second segment of the left supporting piece; and the proximal ends of the right longitudinal bars of the first and second sub-frames are located above and abut the second segment of the right supporting piece, thereby being at least partially supported by the second segment of the right supporting piece.

In many embodiments, the foldable bed frame further includes a first side leg assembly and a second side leg assembly. The first side leg assembly is disposed at a distal side of the first sub-frame, and pivotally coupled with the first sub-frame. The second side leg assembly is disposed at a distal side of the second sub-frame, and pivotally coupled with the second sub-frame.

The supporting leg assemblies and foldable bed frames of the present invention have other features and advantages that will be apparent from or are set forth in more detail in the accompanying drawings, which are incorporated herein, and the following Detailed Description, which together serve to explain certain principles of exemplary embodiments of the present invention.

BRIEF DESCRIPTION OF THE DRAWINGS

The accompanying drawings, which are incorporated into and constitute a part of this specification, illustrate one or more embodiments of the present invention and, together with the detailed description, serve to explain the principles and implementations of exemplary embodiments of the invention.

DETAILED DESCRIPTION

Figure 1:
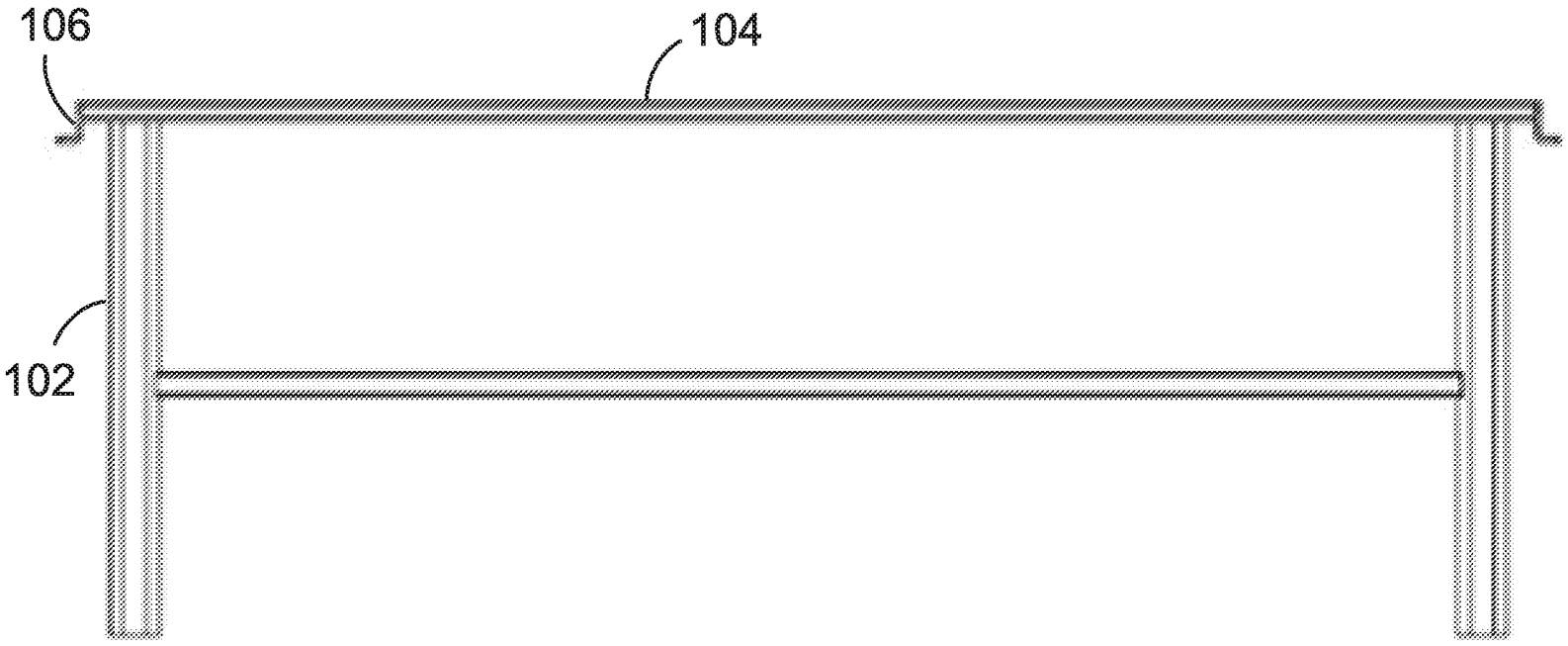
FIG. 1 (Related Art)
FIG. 1 is a side view illustrating a leg assembly of related art.

Reference will now be made in detail to implementations of exemplary embodiments of the present invention as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present invention will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the embodiments set forth in this disclosure can be made without departing from the spirit and scope of the embodiments, as will be apparent to those skilled in the art. The specific embodiments described herein are offered by way of example only.

Embodiments of the present invention are described in the context of leg assemblies and foldable bed frames. The bed frames are of various sizes including but not limited to twin, full, queen and king sizes, and of various shapes including but not limited to rectangles and squares. Also, the bed frames can be made of various materials including but not limited to metals such as steel, plastics and woods.

Generally, a supporting leg assembly of the present invention includes a lateral bar such as first lateral bar 10 and a plurality of legs such as legs 30 fixedly coupled to the first lateral bar. A supporting leg assembly also includes a plurality of supporting pieces such as supporting pieces 20 configured to connect and support sub-frames of a fold bed frame.

Generally, a bed frame of the present invention includes a plurality of sub-frames such as first and second sub-frames 2 pivotally connected to each other at their proximal sides by a supporting leg assembly.

As used herein, the sides at which first and second sub-frames 2 are connected to each other are referred to as their proximal sides, and the sides opposite the proximal sides are referred to as their distal sides. For instance, in FIG. 5, the proximal sides of first and second sub-frames are in the middle of the foldable bed frame. The distal sides correspond to head and foot sections of the bed frame. The other two sides are referred to as left and right sides. It should be noted that the term "middle" as used herein does not necessarily mean the center of the bed frame, and the term "side" does not necessarily mean an outmost edge of the bed frame.

Figure 2:
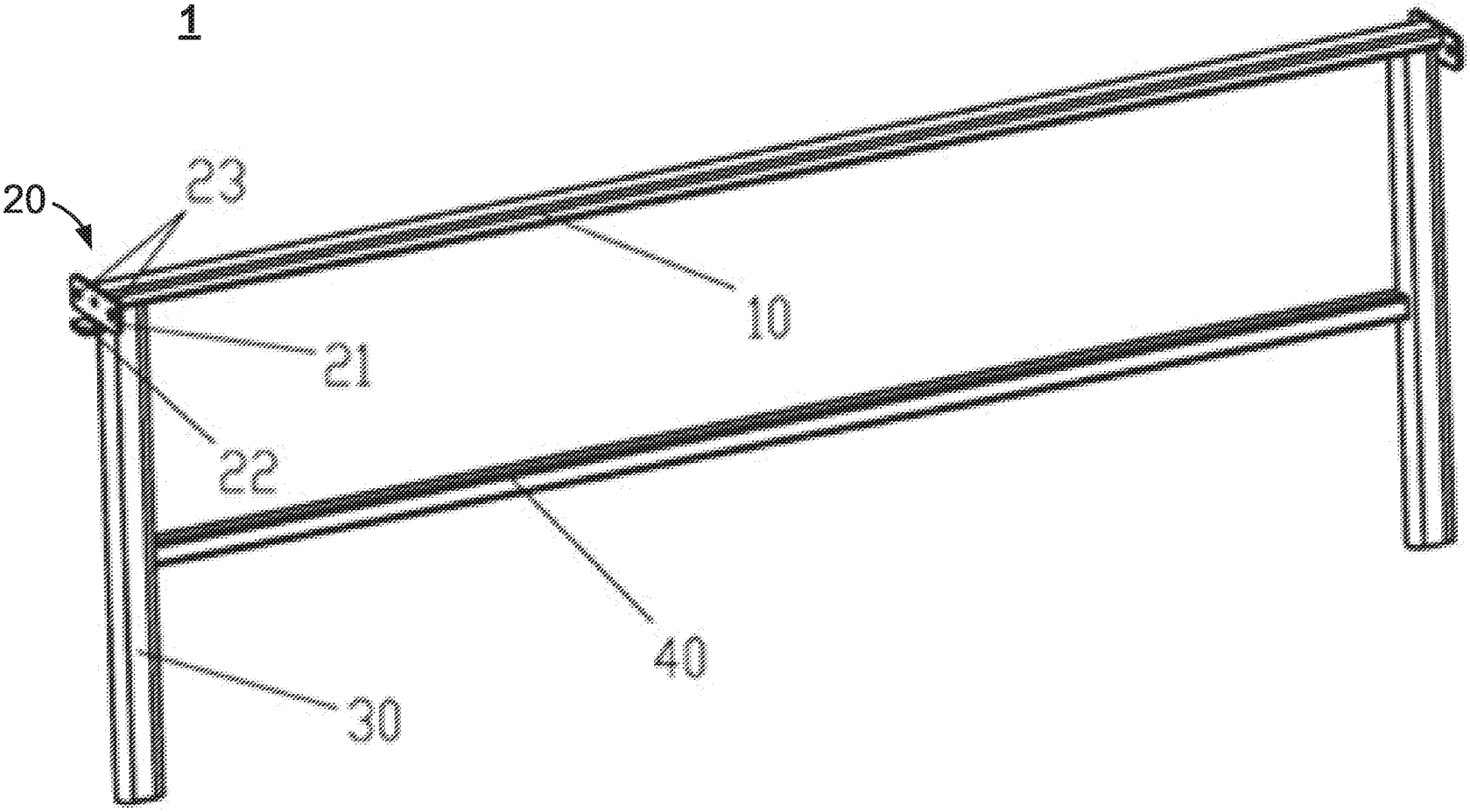
FIG. 2 is a perspective view illustrating a supporting leg assembly in accordance with exemplary embodiments of the present invention.
Figure 3:
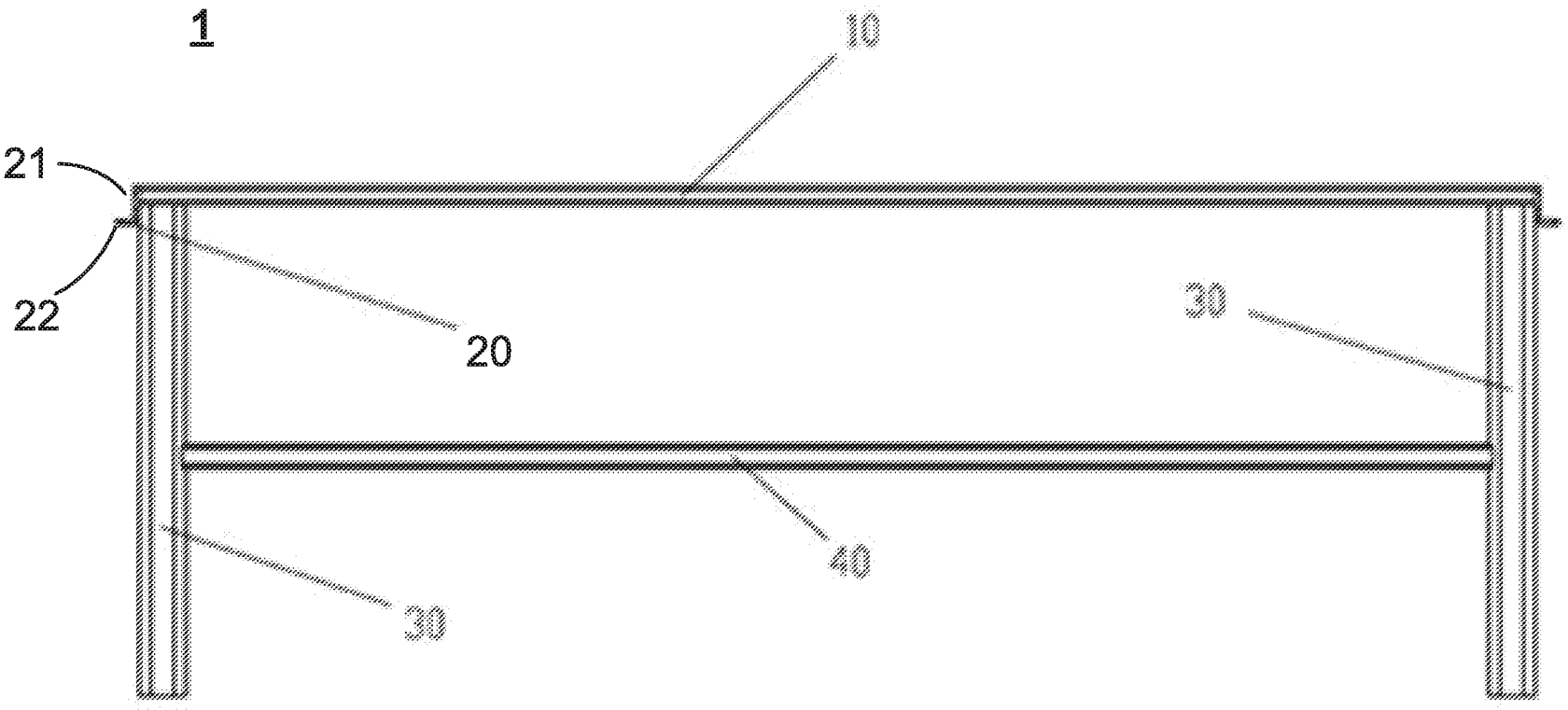
FIG. 3 is a first side view illustrating the supporting leg assembly of FIG. 2.
Figure 4:
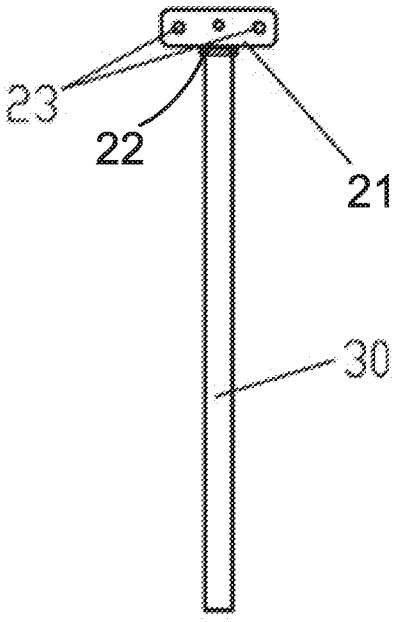
FIG. 4 is a second side view illustrating the supporting leg assembly of FIG. 2.

Referring now to FIGS. 2-4, there is depicted an exemplary supporting assembly 1 in accordance with various embodiments of the present invention. As shown, supporting assembly 1 includes first lateral bar 10, and left and right legs 30. The first lateral bar has a left end and a right end. The left leg is disposed under the left end of the first lateral bar and has an upper end fixedly coupled to the left end of the first lateral bar. The right leg is disposed under the right end of the first lateral bar and has an upper end fixedly coupled to the right end of the first lateral bar. Supporting leg assembly 1 also includes supporting pieces such as supporting piece 20 disposed on the left and right side of the supporting leg assembly. The left supporting piece is in contact with a left side of the left end of the first lateral bar and a left side of the upper end of the left leg, and is fixedly coupled to the left end of the first lateral bar and the upper end of the left leg. The right supporting piece is in contact with a right side of the right end of the first lateral bar and a right side of the upper end of the right leg, and is fixedly coupled to the right end of the first lateral bar and the upper end of the right leg. The left supporting piece can be fixedly coupled to the left end of the first lateral bar and the upper end of the left leg by any suitable methods, including but not limited to welding. Similarly, the right supporting piece can be fixedly coupled to the right end of the first lateral bar and the upper end of the right leg by any suitable methods, including but not limited to welding.

The left and right supporting pieces are configured to connect and support sub-frames of a fold bed frame. In many embodiments, each of the left and right supporting pieces is of an L-shape, having first segment 21 and second segment 22 substantially perpendicular to each other. First segment 21 of the left supporting piece is fixedly coupled to the left end of the first lateral bar and the upper end of the left leg, with an upper portion abutting the left side of the left end of the first lateral bar and a lower portion abutting the left side of the upper end of the left leg. Second segment 22 of the left supporting piece is coupled to, or integrally formed at, the lower portion of the first segment of the left supporting piece, and extends leftward. Similarly, first segment 21 of the right supporting piece is fixedly coupled to the right end of the first lateral bar and the upper end of the right leg, with an upper portion abutting the right side of the right end of the first lateral bar and a lower portion abutting the right side of the upper end of the right leg. Second segment 22 of the right supporting piece is coupled to, or integrally formed at, the lower portion of the first segment of the right supporting piece, and extends rightward. As such, the second segments of the left and right supporting pieces can be used to carry a load (e.g., supporting sub-frames of a bed frame); and the first segments of the left and right supporting pieces will maintain their integrity (e.g., will not bend, move or alter) while the second segments carry the load.

In some embodiments, the first segments of the left and right supporting pieces are elongated. In some embodiments, the first segment of each of the left and right supporting pieces includes a plurality of through-holes such as through-holes 23 configured for pivotally connecting sub-frames of a bed frame.

In some embodiments, supporting assembly 1 further includes a second lateral bar such as lateral bar 40 disposed between the left leg and the right leg, and having a left end fixedly coupled to the left leg and a right end fixedly coupled to the right leg.

Figure 5:
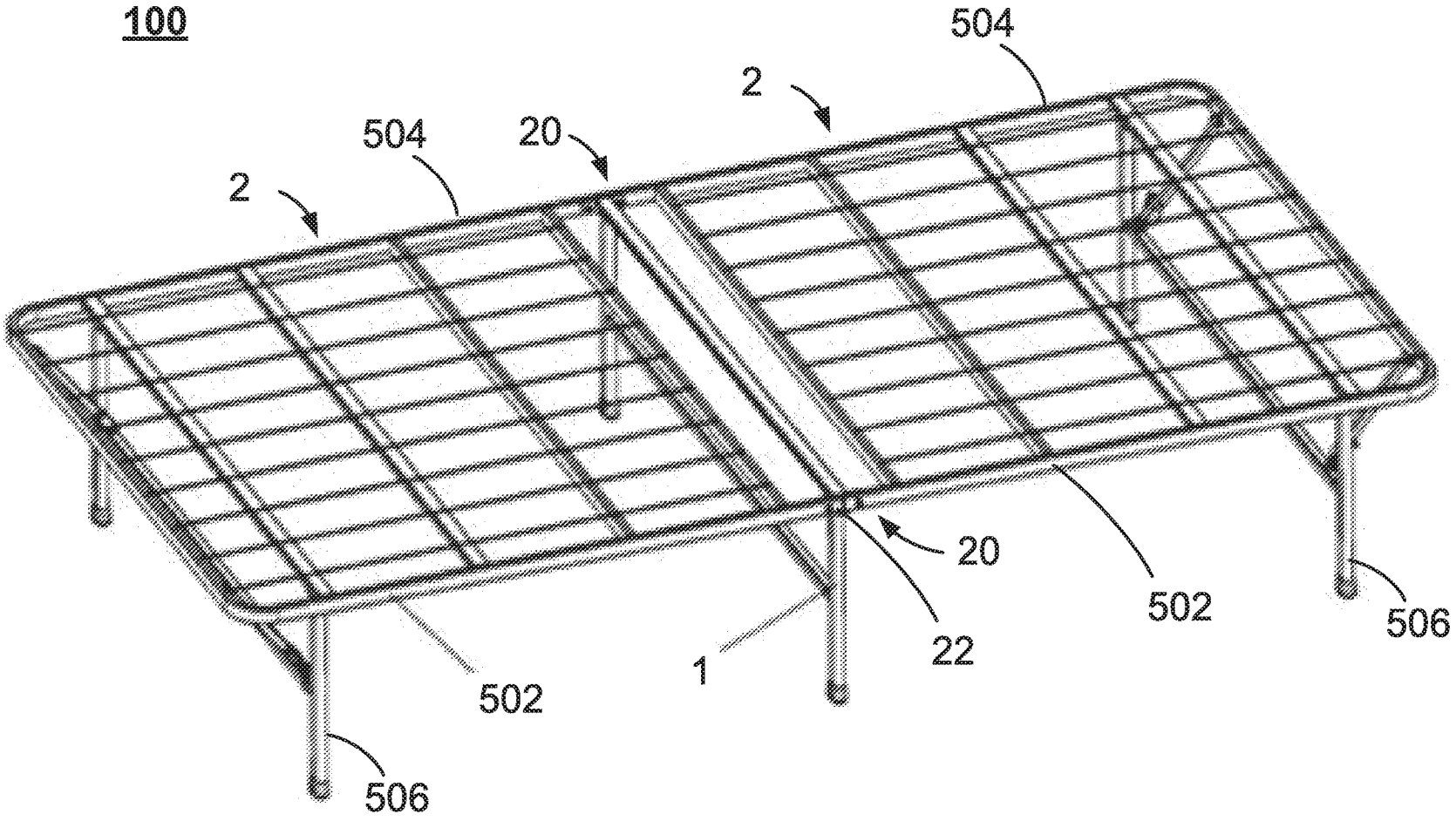
FIG. 5 is a perspective view illustrating a foldable bed frame in an unfolded state in accordance with exemplary embodiments of the present invention.

Referring now to FIG. 5, there is depicted an exemplary foldable bed frame 100 in accordance with various embodiments of the present invention. As shown, foldable bed frame 100 includes first and second sub-frames 2, and supporting leg assembly 1. Each of the first and second sub-frames includes left longitudinal bar 502 and right longitudinal bar 504. Proximal ends of the left longitudinal bars 502 of the first and second sub-frames are pivotally connected to the left supporting piece of the supporting leg assembly 1. Proximal ends of the right longitudinal bars 504 of the first and second sub-frames are pivotally connected to the right supporting piece of the supporting leg assembly 1.

In some embodiments, proximal ends of the left longitudinal bars 502 of the first and second sub-frames are pivotally connected to first segment 21 of the left supporting piece, and proximal ends of the right longitudinal bars 504 of the first and second sub-frames are pivotally connected to first segment 21 of the right supporting piece.

In some embodiments, proximal ends of the left longitudinal bars 502 of the first and second sub-frames are pivotally connected to first segment 21 of the left supporting piece via first and second through-holes 23 formed in first segment 21 of the left supporting piece. Proximal ends of the right longitudinal bars 504 of the first and second sub-frames are pivotally connected to first segment 21 of the right supporting piece via first and second through-holes 23 formed in first segment 21 of the right supporting piece.

When the foldable bed frame is in an unfolded state as illustrated in FIG. 5, the proximal ends of the left longitudinal bars of the first and second sub-frames are located above the second segment of the left supporting piece, and the proximal ends of the right longitudinal bars of the first and second sub-frames are located above the second segment of the right supporting piece, respectively. In some embodiments, the proximal ends of the left longitudinal bars of the first and second sub-frames abut, and thus are at least partially supported by, second segment 22 of the left supporting piece. The proximal ends of the right longitudinal bars of the first and second sub-frames abut, and thus are at least partially supported by, second segment 22 of the right supporting piece. As disclosed herein, first segments 21 of the left and right supporting pieces are fixedly coupled with first lateral bar 10 and legs 30, with upper portions abutting first lateral bar 10 and lower portions abutting legs 30. As such, the first segments of the left and right supporting pieces will not bend, move or alter when proximal ends of the left and right longitudinal bars of the first and second sub-frames abut the second segments of the left and right supporting pieces. As a result, the bed frame of the present invention is more stable, more reliable, and safer to use.

In some embodiments, foldable bed frame 100 further includes first and second side leg assemblies 506. The first side leg assembly is disposed at a distal side of the first sub-frame and pivotally connected to the first sub-frame. The second side leg assembly is disposed at a distal side of the second sub-frame and pivotally connected to the second sub-frame.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "left" or "right", "longitudinal" or "lateral", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first sub-frame could be termed a second sub-frame, and, similarly, a second sub-frame could be termed a first sub-frame, without changing the meaning of the description, so long as all occurrences of the "first sub-frame" are renamed consistently and all occurrences of the "second sub-frame" are renamed consistently.

What is claimed is:

1. A supporting leg assembly of a foldable bed frame comprising:

a first lateral bar having a left end and a right end;

a left leg disposed under the left end of the first lateral bar and having an upper end fixedly coupled to the left end of the first lateral bar, wherein a left side of the upper end of the left leg is aligned substantially with a left side of the left end of the first lateral bar;

a right leg disposed under the right end of the first lateral bar and having an upper end fixedly coupled to the right end of the first lateral bar, wherein a right side of the upper end of the right leg is aligned substantially with a right side of the right end of the first lateral bar; and left and right supporting pieces configured to connect and support sub-frames of a fold bed frame, each of the left and right supporting pieces comprising a first segment, wherein the first segment of the left supporting piece is in contact with the left side of the left end of the first lateral bar and the left side of the upper end of the left leg, and fixedly coupled to the left end of the first lateral bar and the upper end of the left leg, with an upper portion thereof abutting the left side of the left end of the first lateral bar and a lower portion thereof abutting the left side of the upper end of the left leg; and the first segment of the right supporting piece is in contact with the right side of the right end of the first lateral bar and the right side of the upper end of the right leg, and fixedly coupled to the right end of the first lateral bar and the upper end of the right leg, with an upper portion thereof abutting the right side of the right end of the first lateral bar and a lower portion thereof abutting the right side of the upper end of the right leg.

2. The supporting leg assembly of claim 1, further comprising:

a second lateral bar disposed between the left leg and the right leg, and having a left end fixedly coupled to the left leg and a right end fixedly coupled to the right leg.

3. The supporting leg assembly of claim 1, wherein:

the left supporting piece is fixedly coupled to the left end of the first lateral bar and the upper end of the left leg by welding; and the right supporting piece is fixedly coupled to the right end of the first lateral bar and the upper end of the right leg by welding.

4. The supporting leg assembly of claim 1, wherein:

each of the left and right supporting pieces is of an L-shape, and further comprises a second segment substantially perpendicular to the first segment;

the second segment of the left supporting piece is coupled to, or integrally formed at, the lower portion of the first segment of the left supporting piece, and extends leftward;

and the second segment of the right supporting piece is coupled to, or integrally formed at, the lower portion of the first segment of the right supporting piece, and extends rightward.

5. The supporting leg assembly of claim 4, wherein the first segment of each of the left and right supporting pieces comprises a plurality of through-holes.

6. The supporting leg assembly of claim 4, further comprising:

a second lateral bar disposed between the left leg and the right leg, and having a left end fixedly coupled to the left leg and a right end fixedly coupled to the right leg.

7. The supporting leg assembly of claim 4, wherein:

the first segment of the left supporting piece is fixedly coupled to the left end of the first lateral bar and the upper end of the left leg by welding; and the first segment of the right supporting piece is fixedly coupled to the right end of the first lateral bar and the upper end of the right leg by welding.

8. A foldable bed frame comprising:

a first sub-frame and a second sub-frame, wherein each of the first and second sub-frames comprises a left longitudinal bar and a right longitudinal bar; and a supporting leg assembly of claim 1, the supporting leg assembly connecting the first and second sub-frames, wherein proximal ends of the left longitudinal bars of the first and second sub-frames are pivotally connected to the left supporting piece of the supporting leg assembly, and proximal ends of the right longitudinal bars of the first and second sub-frames are pivotally connected to the right supporting piece of the supporting leg assembly.

9. The foldable bed frame of claim 8, wherein the supporting leg assembly further comprises:

a second lateral bar disposed between the left leg and the right leg, and having a left end fixedly coupled to the left leg and a right end fixedly coupled to the right leg.

10. The foldable bed frame of claim 8, wherein:

each of the left and right supporting pieces is of an L-shape, and further comprises a second segment substantially perpendicular to the first segment;

the second segment of the left supporting piece is coupled to, or integrally formed at, the lower portion of the first segment of the left supporting piece, and extends leftward;

the second segment of the right supporting piece is coupled to, or integrally formed at, the lower portion of the first segment of the right supporting piece, and extends rightward;

the proximal ends of the left longitudinal bars of the first and second sub-frames are pivotally connected to the first segment of the left supporting piece of the supporting leg assembly; and the proximal ends of the right longitudinal bars of the first and second sub-frames are pivotally connected to the first segment of the right supporting piece of the supporting leg assembly.

11. The foldable bed frame of claim 10, wherein when the foldable bed frame is in an unfolded state:

the proximal ends of the left longitudinal bars of the first and second sub-frames are located above and abut the second segment of the left supporting piece, thereby being at least partially supported by the second segment of the left supporting piece; and the proximal ends of the right longitudinal bars of the first and second sub-frames are located above and abut the second segment of the right supporting piece, thereby being at least partially supported by the second segment of the right supporting piece.

12. The foldable bed frame of claim 10, wherein:

the first segment of each of the left and right supporting pieces comprises a first through-hole for pivotally connecting with the proximal end of the left or right longitudinal bar of the first sub-frame and a second through-hole for pivotally connecting with the proximal end of the left or right longitudinal bar of the second sub-frame.

13. The foldable bed frame of claim 8, wherein the supporting leg assembly further comprises:

a second lateral bar disposed between the left leg and the right leg, and having a left end fixedly coupled to the left leg and a right end fixedly coupled to the right leg.

14. The foldable bed frame of claim 8, further comprising:

a first side leg assembly disposed at a distal side of the first sub-frame, and pivotally coupled with the first sub-frame; and a second side leg assembly disposed at a distal side of the second sub-frame, and pivotally coupled with the second sub-frame.

15. A foldable bed comprising the foldable bed frame of claim 8.

* * * * *